US005537785A

United States Patent [19]

Zaccagni

[11] Patent Number: 5,537,785

[45] Date of Patent: Jul. 23, 1996

[54] FASCIA/GUTTER WITH CHANNEL

[75] Inventor: Richard J. Zaccagni, Downers Grove, Ill.

[73] Assignee: ZMC, Inc., Addison, Ill.

[21] Appl. No.: 304,277

[22] Filed: Sep. 12, 1994

Related U.S. Application Data

[63] Continuation-in-part of Ser. No. 238,657, May 5, 1994, abandoned.

[51] Int. Cl.[6] ..... E04D 13/064; E04D 13/072; E04D 13/076

[52] U.S. Cl. ..... 52/11; 52/94

[58] Field of Search ..... 52/11, 94, 95; 248/48.1, 48.2

[56] References Cited

U.S. PATENT DOCUMENTS

| | | | |
|---|---|---|---|
| 688,595 | 12/1901 | Coe . | |
| 846,238 | 3/1907 | O'Dowd . | |
| 2,843,063 | 7/1958 | Thomson . | |
| 2,890,664 | 6/1959 | Rachlin . | |
| 3,550,381 | 12/1970 | South | 52/11 X |
| 3,612,453 | 10/1971 | Zimmer . | |
| 3,744,203 | 7/1973 | Sablom, Jr. . | |
| 3,864,882 | 2/1975 | Lasscock . | |
| 3,874,131 | 4/1975 | Webster . | |
| 3,913,284 | 10/1975 | Hall | 52/11 |
| 3,939,616 | 2/1976 | Schapker . | |
| 4,092,808 | 6/1978 | Maloney, Jr. et al. . | |
| 4,195,452 | 1/1980 | Smith et al. . | |
| 4,461,128 | 7/1984 | Knoebl . | |
| 4,580,374 | 4/1986 | Quinnell | 52/95 |
| 4,848,043 | 7/1989 | Nichols et al. . | |

FOREIGN PATENT DOCUMENTS

| | | | |
|---|---|---|---|
| 32112 | 2/1973 | Australia . | |
| 1270110 | 6/1990 | Canada . | |
| 2678013 | 12/1992 | France . | |
| 2726607 | 12/1978 | Germany . | |
| 2735975 | 2/1979 | Germany . | |
| 93934 | 3/1959 | Norway . | |
| 848635 | 9/1960 | United Kingdom | 52/11 |
| 1143421 | 2/1969 | United Kingdom | 52/11 |
| 1469769 | 4/1978 | United Kingdom . | |
| 2239274 | 6/1991 | United Kingdom . | |

*Primary Examiner*—Wynn E. Wood
*Assistant Examiner*—Laura A. Saladino
*Attorney, Agent, or Firm*—Dressler, Goldsmith, Shore & Milnamow, Ltd.

[57] ABSTRACT

A building fascia is disclosed, which comprises an elongate gutter and a soffit. Being made from sheet aluminum, steel, or copper, the gutter has back, bottom, and front walls and a channel extending along and into the gutter from the back or bottom wall, preferably from the back wall. Being made therefrom or from vinyl or other polymeric material, the soffit has an edge portion inserted into the channel. Lips formed on the edge portion and on one of two side walls of the channel have sufficient flexibility and are shaped to permit the edge portion to be readily inserted with a snap action but to restrain the edge portion against being withdrawn from the panel. Preferably, one of the side walls of the channel is spaced narrowly from the bottom wall of the gutter, the narrowly spaced walls flaring into the gutter so that ice forming between the narrowly spaced walls is extruded into the gutter. The gutter has a rib extending along an upper edge of the front wall, a ledge sloping downwardly and backwardly from a lower edge of the rib, and a flange extending and sloping downwardly and frontwardly from a lower edge of the ledge. The building fascia further comprises a mounting bracket extending across the gutter, between the upper edge of the front wall and an upper edge of the back wall. A front portion of the mounting bracket is shaped as a hook and is hooked over the flange.

13 Claims, 2 Drawing Sheets

FIG. 1
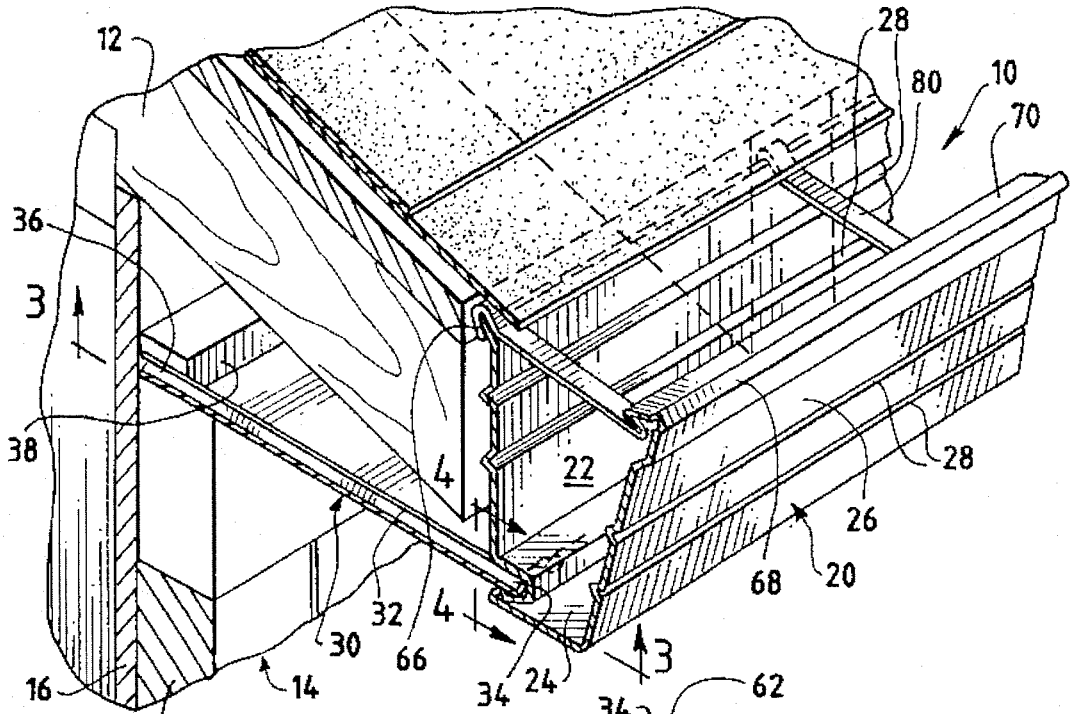
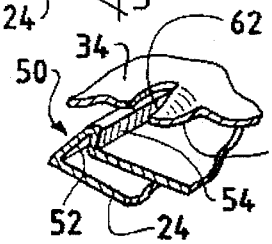
FIG. 2
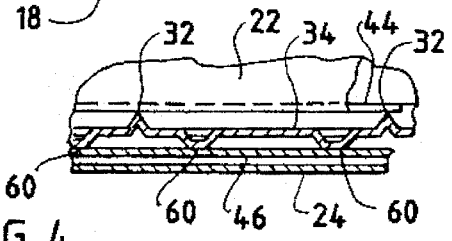
FIG. 4
FIG. 3
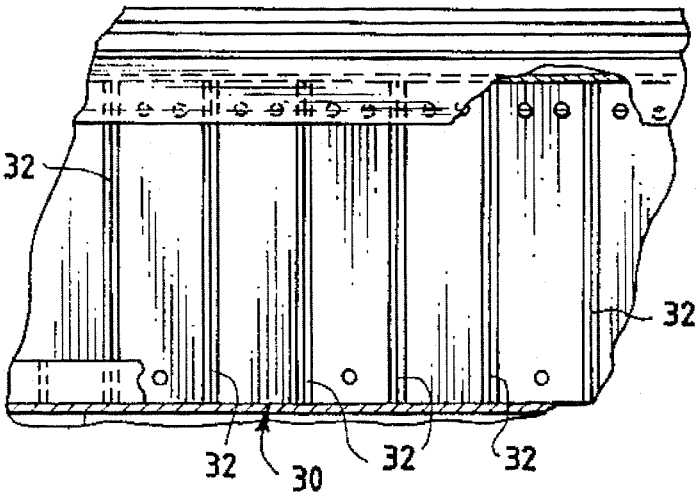

FASCIA/GUTTER WITH CHANNEL

CROSS-REFERENCE TO RELATED APPLICATION

This application is a continuation-in-part of U.S. patent application Ser. No. 08/238,657, now abandoned, which was filed on May 5, 1994, which is assigned commonly herewith, and the disclosure of which is incorporated herein by reference.

TECHNICAL FIELD OF THE INVENTION

This invention pertains to a building fascia comprising an elongate, rain-carrying gutter, with which a soffit may be advantageously combined. This invention contemplates that the gutter may have a channel, into which an edge portion of the soffit may be readily inserted, and that lips provided on a wall of the channel and on the soffit may be advantageously employed for restraining the edge portion against being withdrawn from the channel without any need for fasteners penetrating the gutter. This invention contemplates that the gutter may have a ledge sloping downwardly and backwardly into the gutter, from a rib extending along an upper, front edge of the gutter, for deflecting rain that strikes the ledge into the gutter so as to minimize dripping and streaking along a front surface of the gutter.

BACKGROUND OF THE INVENTION

A building fascia of a type comprising an elongate, rain-carrying gutter combined with a soffit is disclosed in Maloney et al. U.S. Pat. No. 4,092,808. As disclosed therein, the gutter is roll-formed from sheet metal such as prefinished aluminum so as to have a socket groove, into which an edge portion of a soffit is inserted.

As disclosed in the Maloney et al. patent, the gutter has a back wall, a bottom wall, and a front wall. As illustrated therein, the back and front walls flare upwardly so as to permit any ice forming in the gutter between those walls to be extruded upwardly without spreading those walls as the ice expands.

The building fascia of the type disclosed in the Maloney et al. patent is available commercially from Omni Products, a division of ZMC, Inc. of Addison, Ill., under the trademark OMNI FACADE.

A known practice of some installers working with such building fasciae has been to apply fasteners such as screws through holes made in the gutters and in the soffits to secure the edge portions of the soffits in the socket grooves of the gutters. A disadvantage of such a practice is that the gutters may leak at such holes despite measures such as gasketing that may be taken to retard leakage.

Heretofore, as illustrated in the Maloney et al. patent, a known arrangement for mounting the gutter in such a building fascia has employed a flat, horizontal ledge having a hooked flange, having an upper surface extending inwardly and horizontally, and extending from an upper, front edge of the gutter, together with a mounting bracket having a hooked end that is hooked over the hooked flange. A disadvantage of such a flat, horizontal ledge is that rain striking the horizontally extending upper surface of the ledge tends to drip along a front surface of the gutter and to streak the front surface.

This invention improves a building fascia of the type noted above by addressing and eliminating the aforenoted disadvantages.

SUMMARY OF THE INVENTION

According to a first aspect of this invention, a building fascia comprises an elongate, upwardly opening gutter and a soffit. The gutter is roll-formed from a sheet of metal so as to have a back wall, a bottom wall, and a front wall, so as to have a roll-formed channel having an inner wall and two spaced-apart walls and extending along and into the gutter, and so as to have a roll-formed lip extending along the channel. The soffit has an edge portion inserted into the channel, in which the lip is adapted to engage the edge portion so as to restrain the edge portion against being pulled from the channel.

Preferably, the soffit has a lip adapted to engage the lip extending along the channel so as to restrain the edge portion against being pulled from the channel. Preferably, the lip of the soffit is one of a plurality of lips spaced from one another along the soffit and adapted to engage the lip extending along the channel so as to restrain the edge portion against being pulled from the channel. If the soffit is formed from a sheet of metal, these lips may be advantageously formed by deforming the edge portion of the soffit.

Preferably, moreover, the lips of the edge portion of the soffit and the lip extending along the channel have sufficient flexibility and are shaped complementarily so that the lips of the edge portion of the soffit can be readily cammed past the lip extending along the channel with a snap action when the edge portion of the soffit is inserted into the channel but are blocked by the lip extending along the channel so as to restrain the edge portion of the soffit against being withdrawn from the channel. Desirably, if the lip extending along the channel has an outer wall and an inner wall, those walls may flare into the gutter so as to permit any ice forming in a space between those walls to be extruded into the gutter without spreading those walls as the ice expands.

In the building fascia, the channel may extend along and into the gutter from one of the back and bottom walls of the gutter, preferably from the back wall. If the channel extends from the back wall, the spaced-apart walls of the channel are comprised of a lower wall and an upper wall. If the lower wall of the channel is spaced narrowly from the bottom wall of the gutter, those walls may flare into the gutter so as to permit any ice forming in a space between those walls to be extruded into the gutter without spreading those walls as the ice expands.

Herein, as shown in the drawings, applicant has used the term "flare" and related terms with reference to certain walls to mean that those walls spread so as to be progressively farther apart from one another.

These and other objects, features, and advantages of this invention are evident from the following description of a preferred embodiment of this invention with reference to the accompanying drawings.

BRIEF DESCRIPTION OF THE DRAWINGS

FIG. 1 is a fragmentary, perspective view of a building fascia comprising a gutter and a soffit and constituting a preferred embodiment of this invention, as mounted to other building components.

FIG. 2 is an enlarged, fragmentary detail showing interengaging lips in a channel of the gutter and on an edge portion of the soffit.

FIG. 3 is a fragmentary, sectional view taken along line 3—3 of FIG. 1, in a direction indicated by arrows.

FIG. 4 is a fragmentary, sectional view taken along line 4—4 of FIG. 1, in a direction indicated by arrows.

DETAILED DESCRIPTION OF THE PREFERRED EMBODIMENT

Figure 5:
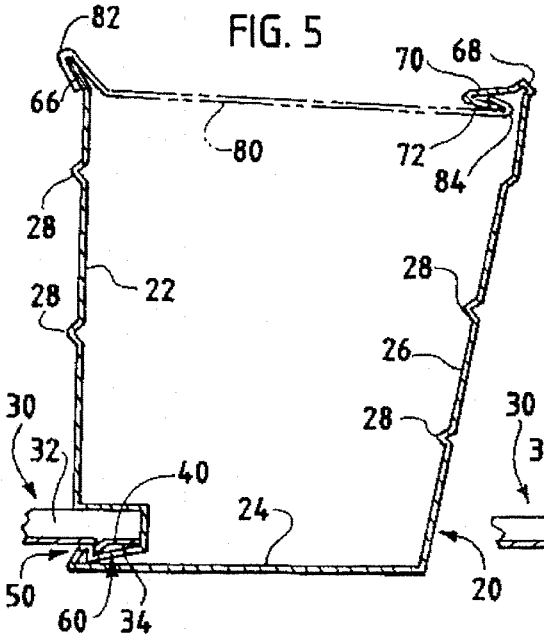
FIG. 5, on an enlarged scale, is a cross-sectional view of the gutter and the soffit, as employed in the building fascia shown in FIGS. 1, 2, 3, and 4, the soffit being shown fragmentarily.

As shown in FIGS. 1, 2, and 3, a building fascia 10 constituting a preferred embodiment of this invention is mounted to wood rafter ends 12 projecting from a building wall 14, which is covered by a wood sheathing panel 16 underlying brick veneer 18 or other siding material. The building fascia 10 is of the type noted above and comprises an elongate, rain-carrying gutter 20 roll-formed from a suitable material such as sheet aluminum, steel, or copper, preferably aluminum, which may be pre-finished with paints or otherwise. The gutter 20 is roll-formed so as to have a back wall 22, a bottom wall 24, and a front wall 26 with reinforcing ribs 28 extending along the back wall 22 and along the front wall 26. In a known manner, the ends (not shown) of the gutter 20 are connected to other gutters, connected to downspouts, or capped.

The building fascia 10 further comprises a soffit 30 roll-formed from a similar material or formed from a suitable vinyl or other polymeric material. The soffit 30 is formed so as to be substantially planar, and so as to have reinforcing ribs 32, which extend transversely across the soffit 30, and which are spaced longitudinally from one another along the soffit 30. The soffit 30 has a front edge portion 34 and a back edge portion 36. The back edge portion 36 is mounted to the building wall 14 via nails or other fasteners (not shown) fastening the back edge portion 36 to a wood mounting cleat 38 and fastening the mounting cleat 38 to the building wall 14. The front edge portion 34 of the soffit 30 is inserted into a channel 40, which is formed in the gutter 20 in a novel manner described below, and is retained in the channel 40 in a novel manner described below.

Except as illustrated and described herein, the building fascia 10 is similar to a building fascia comprising an elongate gutter and a soffit and disclosed in Maloney et al. U.S. Pat. No. 4,092,808, the disclosure of which is incorporated herein by reference. As compared to the building fascia disclosed therein, the building fascia 10 embodies significant improvements, which are described below.

In the building fascia 10, the gutter 20 is roll-formed so as to have the channel 40, which extends along and into the gutter 20, from the back wall 22. The channel 40 has an inner wall 42 and two spaced-apart walls, namely an upper wall 44 and a lower wall 46. The lower wall 46 is spaced narrowly from the bottom wall 24 of the gutter 20. As shown in FIGS. 4 and 5, the lower wall 46 of the channel 40 and the bottom wall 24 of the gutter 20 flare backwardly into the gutter 20, so as to permit any ice extruded into or forming in a space between the wall 46 and the wall 24 to be extruded into the gutter 20.

Moreover, the gutter 20 is roll-formed so as to have a lip 50, which projects upwardly from the lower wall 46. The lip 50 extends partly across the channel 40 and along the channel 40. The lip 50 has two narrowly spaced walls, namely an outer wall 52 and an inner wall 54, and a rounded edge 56 joining the outer wall 52 and the inner wall 54. As shown in FIGS. 4 and 5, the outer wall 52 slopes upwardly and inwardly. Moreover, the outer wall 52 and the inner wall 54 flare downwardly into the space between the wall 46 and the wall 24, so as to permit any ice forming in a space between the wall 52 and the wall 54 to be extruded into the space between the wall 46 and the wall 24, and from the space between the wall 46 and the wall 24 into the gutter 20.

The edge portion 34 of the soffit 30 is formed with a series of lips 60, which are similar to one another, and which are spaced longitudinally from one another. As shown, the lips 60 extend from planar regions of the soffit 30, between the reinforcing ribs 32. Preferably, each lip 60 is formed by piercing and deforming the edge portion 34 by means a suitable tool, so as to provide such lip 60 with a curved edge 62 facing backwardly and with a camming surface 64 curving backwardly to the curved edge 62. Each lip 60 may be alternatively formed by piercing and deforming the edge portion 34 so as to form a tab (not shown) bent downwardly and having a lower edge, two side edges, and a sloping camming surface sloping backwardly to the lower edge or so as to form a tab (not shown) bent downwardly and having a lower point, two side edges, and a camming surface sloping backwardly to the lower point.

Figure 6:
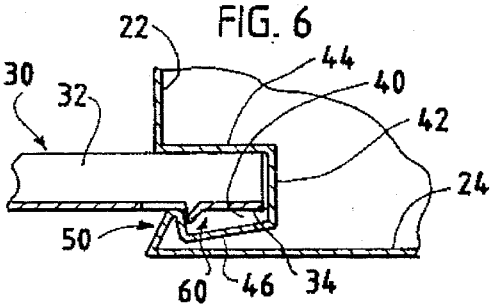
FIG. 6 is a further enlarged, fragmentary detail taken from FIG. 5.

The lip 50 of the gutter 20 and the lips 60 of the edge portion 38 of the soffit 30 are shaped complementarily, as shown in FIGS. 5 and 6 and other views, so that the lips 60 can be readily cammed past the lip 50 with a snap action when the edge portion 34 is inserted into the channel 40 but are blocked by the lip 50 so as to restrain the edge portion 34 against being withdrawn from the channel 40. The material used for the gutter 20 and the soffit 30 provides the lip 50 and the lips 60 with sufficient flexibility to permit the snap action. Alternatively, the edge portion 34 may be inserted into the channel 40 by being slid endwise into the channel 40, through one end of the gutter 20 before the end is closed. The reinforcing ribs 32 provide the soffit 30 with a sufficient thickness for the reinforcing ribs 32 to bear against the upper wall 44 of the channel 40 so that the lips 60 do not override the lip 50 but bear against the lip 50 if and when the soffit 30 is pulled outwardly.

As shown in FIGS. 1 and 5, the gutter 20 has a flange 66 extending upwardly and backwardly from the upper edge of the back wall 22. Also, the gutter 20 has a rib 68 opening downwardly and backwardly, extending along the upper edge of the front wall 26, and being connected to such edge at the lower, front edge of the rib 68. Moreover, the gutter 20 has a ledge 70 sloping downwardly and backwardly into the gutter 20 from the lower, back edge of the rib 68, along with a flange 72 sloping downwardly and frontwardly from the lower edge of the ledge 70.

At spaced intervals along the gutter 20, gutter-mounting brackets 80 of a known type are installed, each bracket 80 having a back portion 82 shaped so as to hook over and hooked over the flange 66 and a front portion 84 shaped so as to hook over and hooked over the flange 72. Nails or other fasteners (not shown) extending through apertures in the back portions 82 may be used to fasten the gutter 20 to the rafter ends 12 via the brackets 80.

Because the rib 68 projects upwardly beyond the ledge 70 and because the ledge 70 slopes downwardly and backwardly, rain striking the ledge 70 tends to be deflected into the gutter 20, not to drip along the front surface 86 of the front wall 26, and not to streak the front surface 86.

Figure 8:
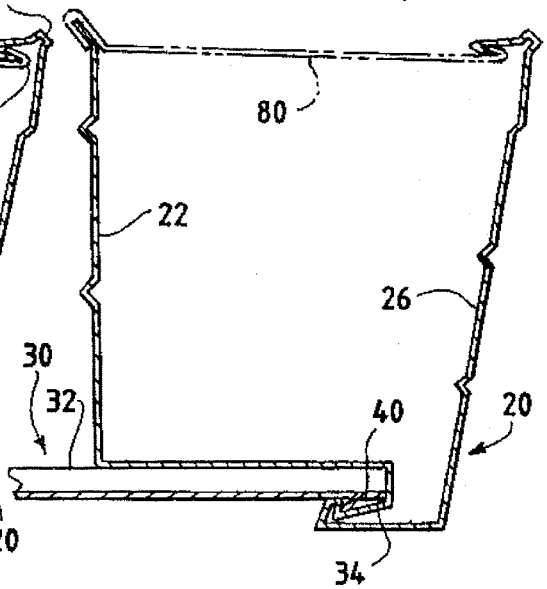
FIGS. 8, 9, and 10 are cross-sectional views of gutters employed in alternative embodiments of this invention.
Figure 7:
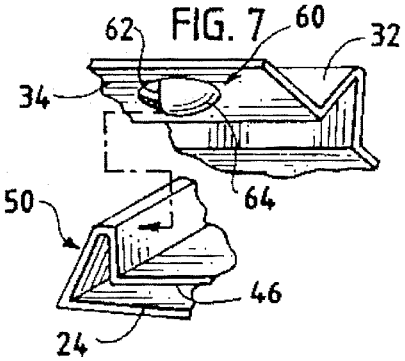
FIG. 7 is a still further enlarged, fragmentary, exploded detail showing the lips shown in FIG. 2.
Figure 9:
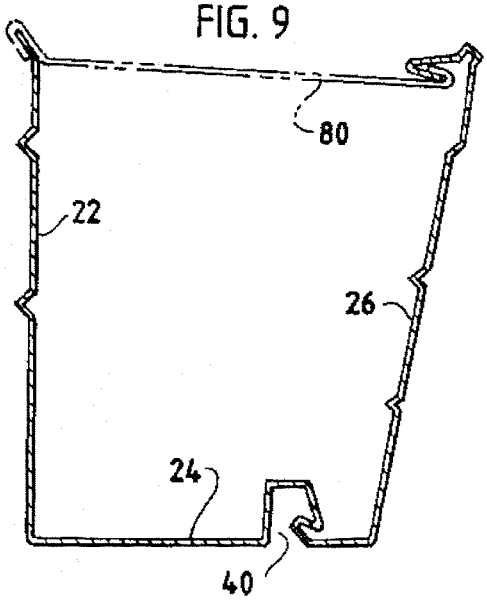
Figure 10:
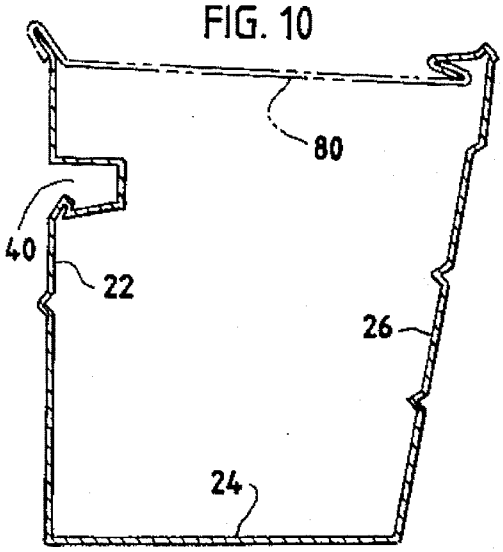

The channel 40 may be alternatively located along the back wall 22, near the bottom wall 24, so as to extend near the front wall 26, as shown in FIG. 8, along the bottom wall 24, as shown in FIG. 9, or at a higher level along the back wall 24, as shown in FIG. 10.

Various other modifications may be made in the preferred embodiment described above without departing from the scope and spirit of this invention.

I claim:

1. A building fascia comprising an elongate, upwardly opening gutter, which is roll-formed in one piece from a sheet of metal so as to have a back wall, a bottom wall, and a front wall, so as to have a roll-formed channel having an inner wall and two spaced-apart walls and extending along and into the gutter, and so as to have a roll-formed lip extending along the channel, the lip extending along and defining an outermost edge of one of the spaced-apart walls of the channel, the building fascia further comprising a soffit having an edge portion adapted to be inserted into the channel, in which the lip is adapted to engage the edge portion so as to restrain the edge portion against being pulled from the channel.

2. The building fascia of claim 1 wherein the soffit has a lip adapted to engage the lip extending along the channel so as to restrain the edge portion against being pulled from the channel.

3. The building fascia of claim 2 wherein the lip of the soffit is one of a plurality of lips spaced from one another along the soffit and adapted to engage the lip extending along the channel so as to restrain the edge portion against being pulled from the channel.

4. The building fascia of claim 3 wherein the soffit is formed from a sheet of metal and wherein the lips of the soffit are formed by deforming the edge portion of the soffit.

5. The building fascia of claim 4 wherein the lips of the edge portion of the soffit and the lip extending along the channel have sufficient flexibility and are shaped complementarily so that the lips of the edge portion of the soffit can be readily cammed past the lip extending along the channel with a snap action when the edge portion of the soffit is inserted into the channel but are blocked by the lip extending along the channel so as to restrain the edge portion of the soffit against being pulled from the channel.

6. The building fascia of claim 1 wherein the lip extending along the channel has an outer wall and an inner wall with a space between the outer and inner walls and wherein the outer and inner walls flare into the gutter so as to permit any ice forming in the space between the outer and inner walls to be extruded into the gutter without spreading the outer and inner walls as the ice expands.

7. The building fascia of claim 6 wherein the channel extends along and into the gutter from one of the back and bottom walls of the gutter.

8. The building fascia of claim 7 wherein the channel extends along and into the gutter from the back wall of the gutter and wherein the spaced-apart walls of the channel are comprised of a lower wall and an upper wall.

9. The building fascia of claim 8 wherein the lower wall of the channel is spaced narrowly from the bottom wall of the gutter.

10. The building fascia of claim 9 wherein the lower wall of the channel and the bottom wall of the gutter flare into the gutter so as to permit any ice forming in the space between the lower wall of the channel and the bottom wall of the gutter to be extruded into the gutter without spreading the lower wall of the channel and the bottom wall of the gutter as the ice expands.

11. The building fascia of claim 10 wherein the lower wall of the channel has the lip extending along the channel.

12. A building fascia comprising an elongate, upwardly opening gutter having a back wall, a bottom wall, and a front wall and having a channel extending along and into the gutter, the channel having an inner wall and two spaced-apart walls, the building fascia further comprising a soffit having an edge portion adapted to be inserted into the channel, wherein one of the spaced-apart walls of the channel and another of the gutter walls are spaced narrowly from each other and flare into the gutter so as to permit any ice forming between the narrowly spaced walls to be extruded into the gutter without expanding the narrowly spaced walls as the ice expands.

13. The building fascia of claim 12 wherein the channel extends along and into the gutter from the back wall of the gutter, wherein the spaced-apart walls of the channel are comprised of a lower wall and an upper wall, the lower wall being spaced narrowly from the bottom wall of the gutter, and wherein the lower wall of the channel and the bottom wall of the gutter flare into the gutter.

* * * * *